US006907943B2

(12) United States Patent
Ikuta

(10) Patent No.: US 6,907,943 B2
(45) Date of Patent: Jun. 21, 2005

(54) ELECTRIC HAMMER

(75) Inventor: Hiroki Ikuta, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 10/759,347

(22) Filed: Jan. 15, 2004

(65) Prior Publication Data

US 2004/0206520 A1 Oct. 21, 2004

(30) Foreign Application Priority Data

Jan. 16, 2003 (JP) ..... 2003-008474

(51) Int. Cl.[7] ..... B25D 11/00

(52) U.S. Cl. ..... 173/117; 173/162.1; 173/201; 173/211; 173/49

(58) Field of Search ..... 173/49, 117, 201, 173/210, 211, 162.1, 162.2

(56) References Cited

U.S. PATENT DOCUMENTS

| | | | | |
|---|---|---|---|---|
| 3,007,230 A | * | 11/1961 | Riedl | 29/76.1 |
| 3,305,031 A | * | 2/1967 | Bez et al. | 173/115 |
| 3,308,729 A | * | 3/1967 | Kestel | 404/133.1 |
| 3,642,077 A | | 2/1972 | Bayard | |
| 3,856,426 A | * | 12/1974 | Waschulewski et al. | 404/133.1 |
| 4,276,941 A | * | 7/1981 | Wanner et al. | 173/117 |
| 4,346,768 A | * | 8/1982 | Ross | 173/118 |
| 4,478,293 A | | 10/1984 | Weilenmann et al. | |
| 4,836,297 A | * | 6/1989 | Dorner et al. | 173/162.1 |
| 5,355,964 A | * | 10/1994 | White | 173/1 |
| 5,607,023 A | * | 3/1997 | Palm | 173/178 |
| 6,315,059 B1 | * | 11/2001 | Geldean | 173/31 |
| 6,352,004 B1 | * | 3/2002 | Greppmair | 74/44 |

FOREIGN PATENT DOCUMENTS

| | | |
|---|---|---|
| DE | 100 52 447 A1 | 5/2002 |
| EP | 0 035 984 A1 | 9/1981 |
| FR | 2 237 734 | 2/1975 |
| GB | 2 053 768 A | 2/1981 |
| GB | 2 129 733 A | 5/1984 |
| JP | 51-6583 | 1/1976 |

* cited by examiner

*Primary Examiner*—Scott A. Smith
(74) *Attorney, Agent, or Firm*—Lahive & Cockfield, LLP; Anthony A. Laurentano, Esq.

(57) ABSTRACT

It is, accordingly, an object of the present invention to provide an electric hammer with improved construction, while ensuring the vibration reduction performance. According to the present invention, a representative electric hammer may include a hammer bit, a driving motor, a crank mechanism and a counter weight. The crank mechanism drives a striker by converting a rotating output of the driving motor to linear motion in the axial direction of the hammer bit. The counter weight is detachably mounted to the crank mechanism and serves to reduce vibration of the striker. According to the representative hammer, because the counter weight is detachably mounted to the crank mechanism, it is possible to switch between the mode in which the counter weight is mounted on the hammer body in order to reduce and alleviate vibration and the mode in which the counter weight is removed from the hammer so that the operation can be performed with the hammer having a lighter weight and slimmer appearance. Thus, utility of the electric hammer can be improved.

14 Claims, 5 Drawing Sheets

ELECTRIC HAMMER

BACKGROUND OF THE INVENTION

1. Field of the Invention

The present invention relates to an electric hammer, and more particularly, to a technique of reducing and alleviating vibration in an electric hammer that drives a hammer bit at a predetermined cycle, such as a hammer and a hammer drill.

2. Description of the Related Art

Japanese unexamined laid-open Utility Model Publication No. 51-6583 discloses a hammer with a vibration reducing device. According to the known hammer, a counter weight is provided on a crank arm mechanism and driven by the crank arm mechanism. The crank arm mechanism is designed to reciprocate the striker that applies a striking force to the hammer bit. The counter weight reciprocates within a gear housing in a direction opposite to the direction of the striker being driven by the crank arm mechanism. Such movement of the counter weight in the opposite direction can effectively reduce and alleviate vibration in the axial direction of the hammer bit during the operation of the hammer.

Such a counter weight requires considerable dimensions in order to appropriately reduce strong vibration during the operation of the hammer. Accordingly, the space for receiving such a dynamic vibration reducer also requires considerable spaces within the hammer. Further, in some cases, no need does exist to mount the counter weight in the hammer, depending on the operating conditions, user needs, etc. Therefore, a further improvement is desired in the rational design of the counter weight in the electric hammer.

SUMMARY OF THE INVENTION

It is, accordingly, an object of the present invention to provide an electric hammer with improved construction, while ensuring the vibration reduction performance.

According to the present invention, a representative electric hammer may include a hammer bit, a driving motor, a crank mechanism and a counter weight. The crank mechanism drives a striker by converting a rotating output of the driving motor to linear motion in the axial direction of the hammer bit. The counter weight is detachably mounted to the crank mechanism and serves to reduce vibration of the striker.

According to the representative hammer, because the counter weight is detachably mounted to the crank mechanism, it is possible to switch between the mode in which the counter weight is mounted on the hammer body in order to reduce and alleviate vibration and the mode in which the counter weight is removed from the hammer so that the operation can be performed with the hammer having a lighter weight and slimmer appearance. Thus, utility of the electric hammer can be improved.

Other objects, features and advantages of the present invention will be readily understood after reading the following detailed description together with the accompanying drawings and the claims.

BRIEF DESCRIPTION OF THE DRAWINGS

In FIG. 2, a dynamic vibration reducer 301 is detachably mounted to the hammer 101 in comparison with the hammer 100 as shown in FIG. 1.

DETAILED DESCRIPTION OF THE REPRESENTATIVE EMBODIMENT OF INVENTION

Figure 1:
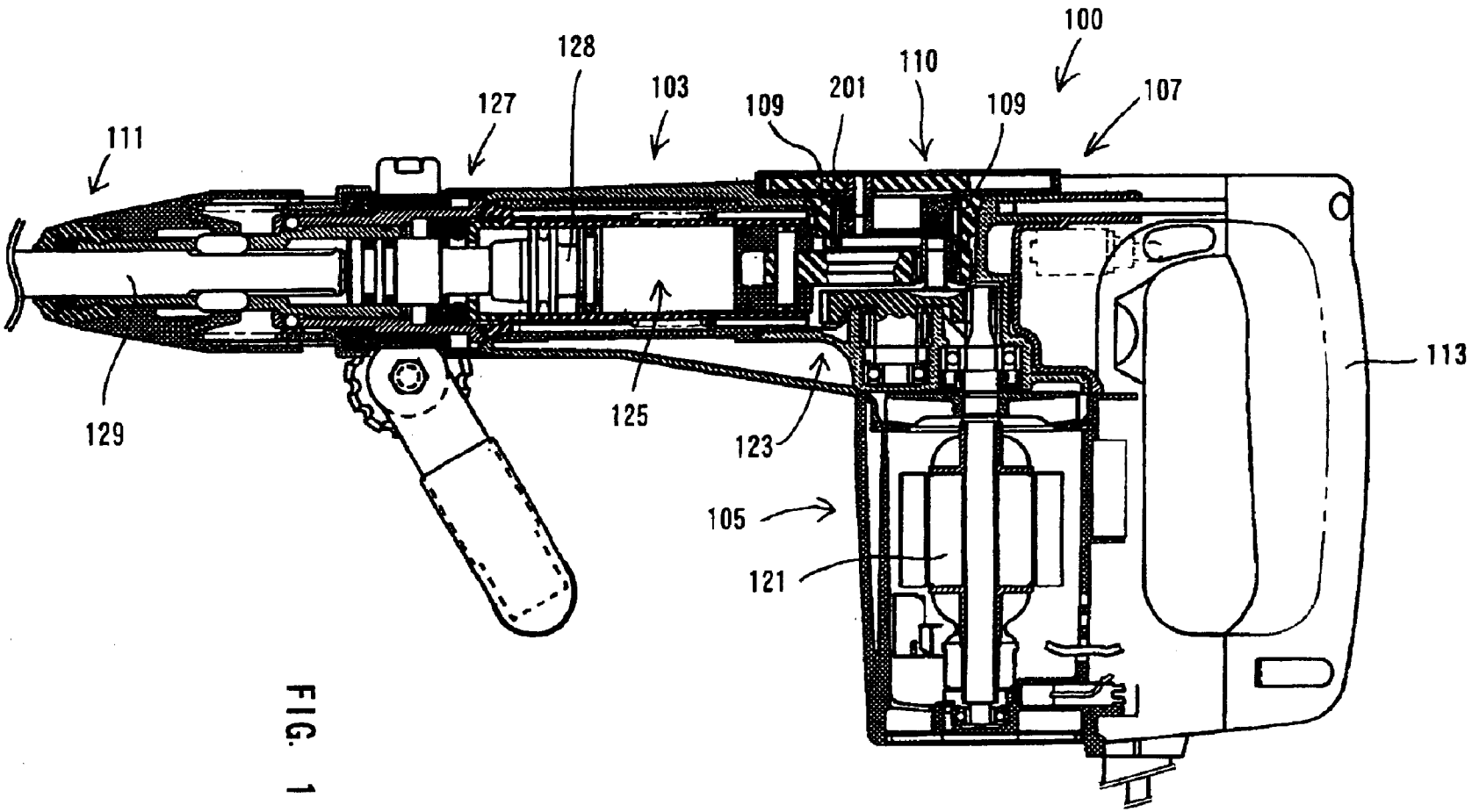
FIG. 1 is a sectional view showing an entire hammer 100 according to the first representative embodiment of the invention.

According to the present invention, a representative electric hammer may include a hammer bit, a driving motor, a crank mechanism and a counter weight. The electric hammer may suitably embrace not only a hammer of the type which performs a hammering function by reciprocating motion of the hammer bit in the axial direction, but a hammer of the drill-hammer type which performs a drilling function by rotation of the hammer bit, as well as the hammering function. The crank mechanism drives a striker by converting a rotating output of the driving motor to linear motion in the axial direction of the hammer bit. The counter weight serves to reduce vibration of the striker. Specifically, the counter weight reciprocates in a direction opposite to the direction of the striker being linearly driven by the crank mechanism. As a result, the kinetic energy (momentum) of the counter weight and the striker is offset against each other, so that the vibration of the entire hammer is effectively reduced.

In the present invention, the counter weight having such function is detachably mounted to the crank mechanism. Therefore, it is possible to switch as appropriate between the mode in which the counter weight is mounted on the hammer body in order to reduce and alleviate vibration and the mode in which the counter weight is removed from the hammer so that the operation can be performed with the hammer having a lighter weight and slimmer appearance, in relation to the operating manners, the need for dynamic vibration reduction or other similar conditions. Further, whether the counter weight is mounted or not is left to the user's discretion, while the hammer is designed such that the counter weight can be mounted. In this manner, the cost and convenience of the electric hammer can be advantageously controlled. Preferably, the counter weight may be mounted and removed through the opening formed over the crank cap or the crank mechanism.

Preferably, a dynamic vibration reducer may be detachably mounted to the hammer according to the present invention. The dynamic vibration reducer may have a body, a weight that is housed in the body and an elastic element that connect the weight to the body. The weight is connected to the body at least by an elastic element. In addition, the weight may preferably be connected to the body by an attenuating element. According to the present invention, in addition to the counter weight, the dynamic vibration reducer serves to reduce and alleviate vibration from the reciprocating motion of the crank mechanism. Thus, the vibration which has not been reduced by the counter weight is further alleviated by the dynamic vibration reducer, so that reliable measures can be taken against vibration in the electric hammer.

Furthermore, the dynamic vibration reducer functions as a passive vibration reducing mechanism which starts the vibration reducing motion according to the vibration of the vibrating body. Therefore, the dynamic vibration reducer effectively works not only to reduce vibration from the crank mechanism but to reduce vibration when the motion of the counter weight does not offset the motion of the crank mechanism. Further, like the counter weight, the dynamic vibration reducer is detachably mounted to the hammer. Therefore, it is possible to switch as appropriate between the mode in which the dynamic vibration reducer is mounted on the hammer body in order to reduce vibration and the mode in which the dynamic vibration reducer is removed from the hammer so that the operation can be performed with the hammer having a lighter weight and slimmer appearance, according to the operating manners, the need for dynamic vibration reduction or other similar conditions. Further, whether the dynamic vibration reducer is mounted or not is left to the user's discretion, while the hammer is designed such that the dynamic vibration reducer can be mounted. In this manner, the cost and convenience of the electric hammer can be advantageously controlled. Preferably, the dynamic vibration reducer may be mounted and removed through the opening formed over the crank cap or the crank mechanism.

As mentioned above, the counter weight according to the present invention reciprocates in a direction opposite to the reciprocating direction of the striker being driven by the crank mechanism, thereby reducing vibration from the striker. The electric hammer operates either in the mode in which the hammer bit performs a predetermined operation on the workpiece, i.e. the mode in which load is applied to the hammer bit (loaded driving conditions), or, in the mode in which the hammer bid does not operate, i.e. the mode in which load is not applied to the hammer bit (unloaded driving conditions). Therefore, the counter weight, which is essentially provided in order to reduce vibration of the driver under loaded driving conditions, may possibly cause vibration under unloaded driving conditions.

In this connection, according to the present invention, the dynamic vibration reducer effectively serves to reduce and alleviate vibration when the counter weight causes vibration under unloaded driving conditions. Specifically, under loaded driving conditions, the dynamic vibration reducer performs vibration reduction of the striker in cooperation with the counter weight of which driving is timed so as to be adapted to the loaded driving conditions. Further, under unloaded driving conditions, the dynamic vibration reducer can perform vibration reduction with respect to the counter weight as well as the striker.

Preferably, the crank mechanism may comprise a gear, an eccentric pin and a crank arm. The gear may be drivingly rotated by an output shaft of the driving motor. The eccentric pin may be eccentrically mounted on the gear and revolves with rotation of the gear. One end of the crank arm may be connected to the eccentric pin and the other end may be connected to the hammer bit striking mechanism, so that the crank arm causes the hammer bit striking mechanism to reciprocate and thus drives the striker. Further, the representative hammer may preferably include a counter weight driving mechanism that is removably connected to the eccentric pin and reciprocates in the axial direction of the hammer bit, thereby driving the counter weight to reciprocate. With this construction, the mechanism for driving the counter weight is removably disposed on the mechanism for driving the crank arm by the driving motor via the output shaft and the gear, so that the counter weight can be efficiently driven.

Additionally, the representative electric hammer may preferably be constructed in which the counter weight driving device has an eccentric pin sliding groove. The eccentric pin may be removably fitted in the eccentric pin sliding groove and allowed to slide with respect to the sliding groove. With this construction, the counter weight driving device for driving the counter weight may engage with the eccentric pin that is mounted on the crank mechanism in order to drive the crank arm, via the eccentric pin sliding groove. The eccentric pin may slide with respect to the counter weight driving device within the sliding groove. When the eccentric pin slides, the counter weight reciprocates via the revolution of the eccentric pin which is caused by rotation of the gear. Further, with the construction in which the eccentric pin is fitted in the sliding groove, the mounting accuracy between the eccentric pin and the sliding groove can be roughly set. Therefore, the cost efficiency in manufacturing and the workability in mounting can be improved.

Further, the representative electric hammer may preferably be constructed in which the counter weight driving device includes a second crank arm. One end of the second crank arm may removably be connected to the eccentric pin and the other end may be connected to the counter weight. With this construction, the reciprocating motion of the counter weight can be obtained via the second crank arm, one end of which is removably connected to the eccentric pin that is provided on the crank mechanism in order to drive the crank arm and the other end is connected to the counter weight. Further, the gear and the eccentric pin which form the crank mechanism and the second crank arm which forms the counter weight driving device are arranged as an integral rigid body. Therefore, these elements can be readily supported with stability when drivingly rotated by the output shaft of the driving motor. Furthermore, because the second crank arm is removably connected to the eccentric pin, when it becomes unnecessary, the counter weight can be removed together with the second crank arm, so that the construction of the electric hammer can be readily simplified. In order to removably connect the second crank arm to the eccentric pin, preferably, a screw or bolt may be utilized.

Moreover, the representative electric hammer may preferably be constructed in which the counter weight and the counter weight driving device can be mounted and removed through the crank cap that is used to dispose the crank arm in the hammer body or through the opening formed above the crank mechanism. With this construction, the existing crank cap or opening above the crank mechanism can be utilized to mount or remove the counter weight and the counter weight driving device. Thus, an electric hammer having efficient construction can be obtained. Further, like the counter weight, preferably, the dynamic vibration reducer may be configured to be mounted and removed through the crank cap.

Each of the additional features and method steps disclosed above and below may be utilized separately or in conjunction with other features and method steps to provide improved electric hammer and method for using such electric hammer and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 2:
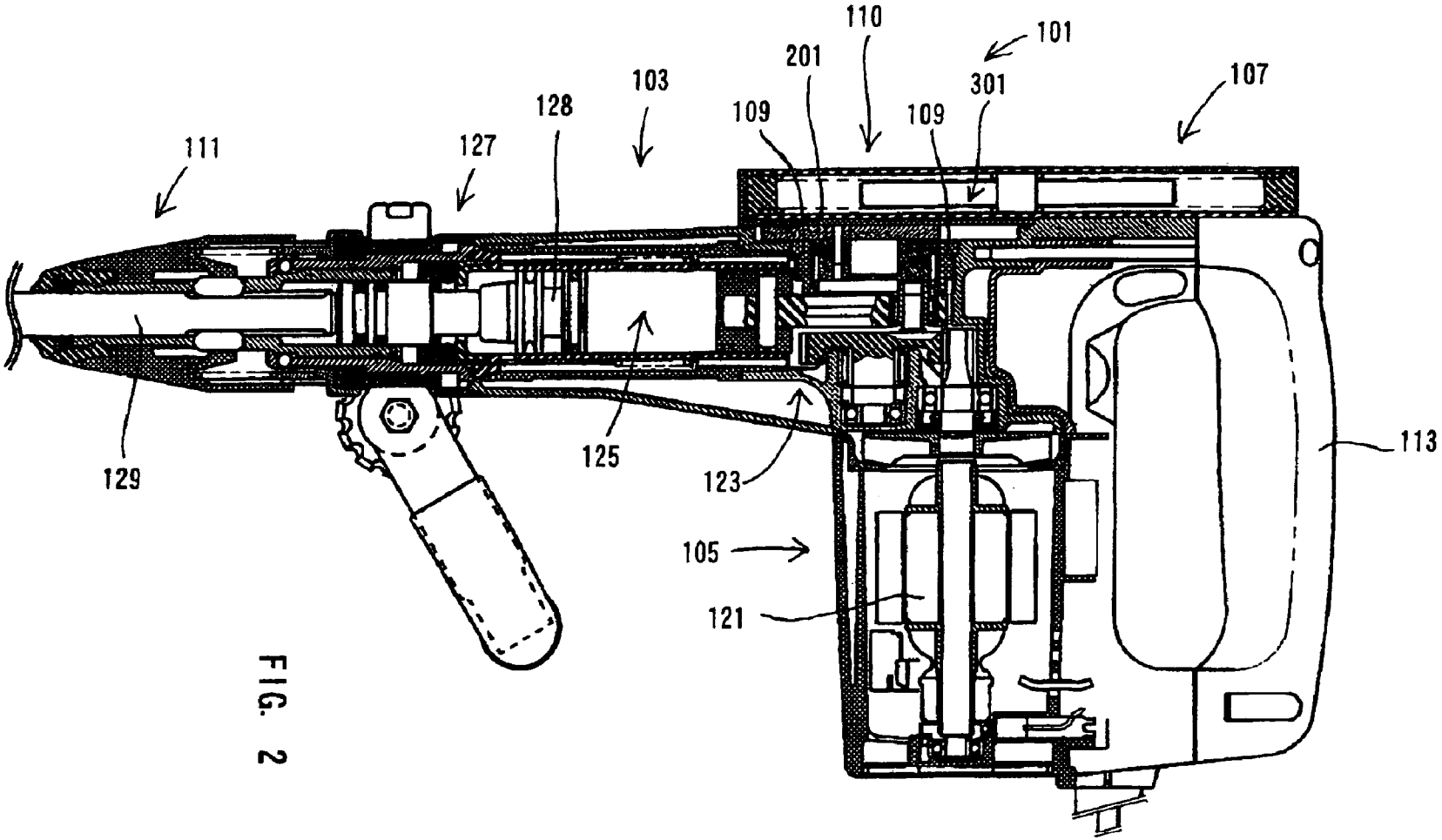
FIG. 2 is a sectional view showing an entire hammer 101 according to the representative embodiment of the invention.

A hammer according to a representative embodiment of the present invention will now be described with reference to the drawings. FIG. 1 shows a representative hammer 100 with a counter weight 201. FIG. 2 shows the representative hammer 101 with a counter weight 201 and a dynamic vibration reducer 301. The hammers 100 and 101 utilize equivalent elements except for a dynamic vibration reducer 301. Such elements will be designated by the same numerals in the drawings and the following description.

As shown in FIG. 1, the representative hammer 100 according to this embodiment comprises a body 103 having a motor housing 105 and a gear housing 107. A hammer bit coupling portion 111 for coupling a hammer bit 129 to the body 103 is provided in the tip end region of the gear housing 107. Further, a handgrip 113 is provided on the rear end side of the motor housing 105 and the gear housing 107.

The motor housing 105 houses a driving motor 121. An opening 110 is formed in the upper surface of the gear housing 7 and a crank cap 109 is disposed within the opening 110. A counter weight 201 and/or a dynamic vibration reducer 301 (see FIG. 2), which is described below in detail, are detachably mounted to the body 103 through the opening 110.

The gear housing 107 houses a motion converting mechanism 123, a cylinder mechanism 125 and a striking element 127. The motion converting mechanism 123 is adapted to convert the rotating output of the driving motor 121 to linear motion in the axial direction of the hammer bit 129. The cylinder mechanism 125 is driven via the motion converting mechanism 123. The striking element 127 mainly includes a striker 128 that applies an impact force to the hammer bit 129 in the axial direction by a striking force obtained from the cylinder mechanism 125.

The counter weight 201 is detachably mounted on the motion converting mechanism 123 of the hammer 100 and in the region right under the opening 110. The counter weight 201 is used to reduce vibration in the axial direction of the hammer bit 129, which vibration is developed in the motion converting mechanism 123.

In the hammer 101 as shown in FIG. 2, in addition to the above-mentioned construction of the hammer 100, the dynamic vibration reducer 301 is detachably mounted on the counter weight 201 and in the region right above the opening 110. During loaded driving operation of the hammer 101, the dynamic vibration reducer 301 serves to reduce and alleviate vibration in the axial direction of the hammer bit 129 which is developed in the motion converting mechanism 123, by cooperation with the counter weight 201. Further, during unloaded driving operation of the hammer 101, the dynamic vibration reducer 301 is adapted to reduce and alleviate vibration caused by the counter weight 201 as well as vibration developed in the motion converting mechanism 123.

Figure 3:
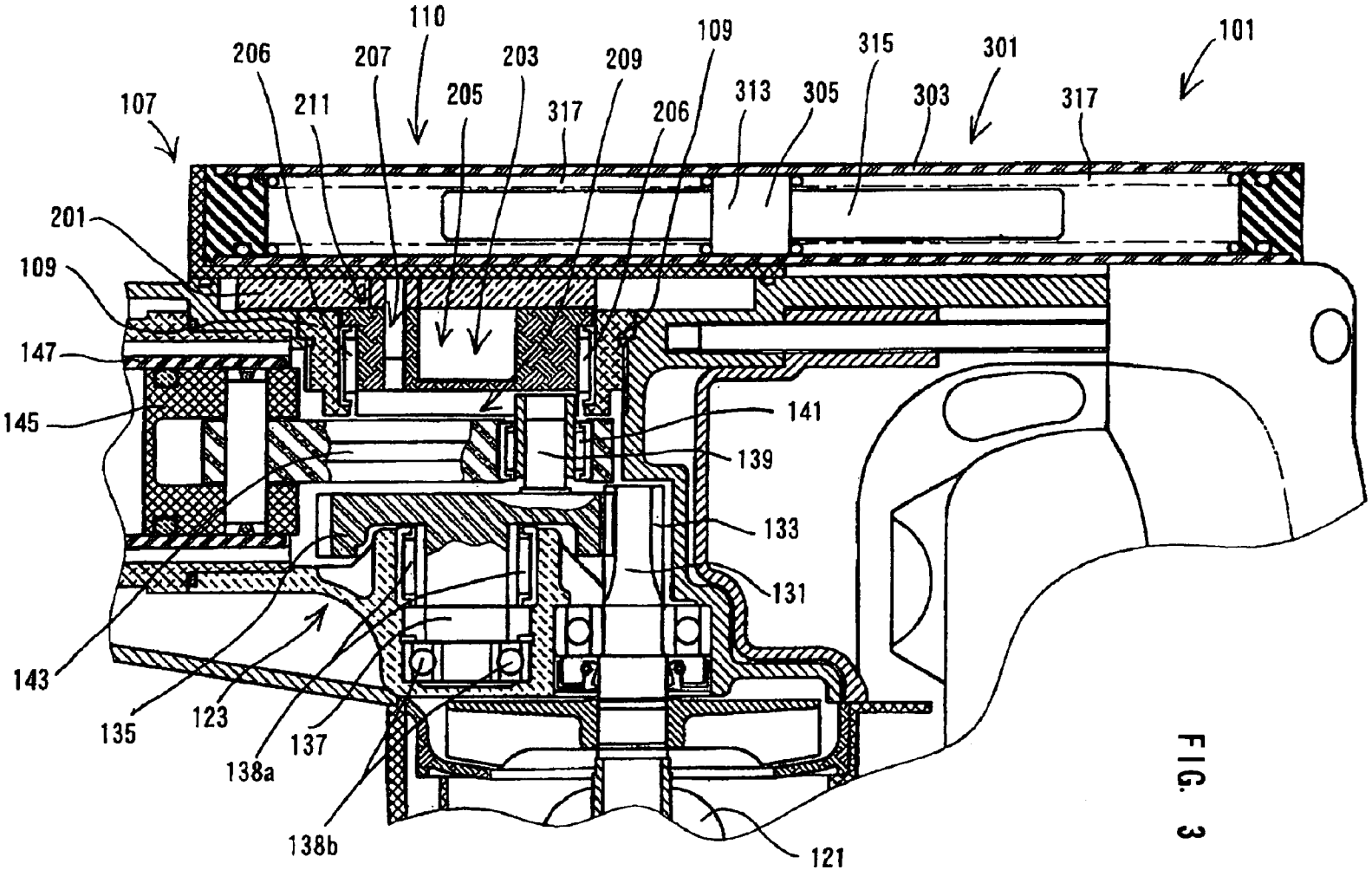
FIG. 3 is a partially sectional view showing an essential part of the representative hammer 101.

FIG. 3 shows an essential part of the hammer 101 including the counter weight 201 and the dynamic vibration reducer 301. The hammer 100 as shown in FIG. 1 has the same construction as the hammer 101 shown in FIG. 2 except for whether the dynamic vibration reducer 301 is mounted or not. Therefore, in order to avoid duplication of explanation, as for description and illustration of the detailed construction of the essential parts of the hammer 100, description and illustration relating to the hammer 101 will also be utilized.

As shown in FIG. 3, the motion converting mechanism 123 of the hammer 101 includes a speed change gear 135, a gear shaft 137, an upper bearing 138*a* and a lower bearing 138*b*, an eccentric pin 139 and a crank arm 143. The speed change gear 135 is rotated by engaging a gear portion 133 of the output shaft 131 of the driving motor 121. The gear shaft 143 integrally rotates with the speed change gear 135. The upper and lower bearings 138*a* and 138*b* rotatably support the gear shaft 137. The eccentric pin 139 is eccentrically disposed in a position displaced from the center of rotation of the speed change gear 135 (or the center of rotation of the gear shaft 137). One end of the crank arm 143 is connected to the eccentric pin 139 via an eccentric pin bearing 141, and the other end of the crank arm 143 is connected to a driver 145 that is disposed within a cylinder 147. The driver 145 slides within the cylinder 147 so as to linearly drive a striker, which is not shown for the sake of convenience, by a so-called air spring function. As a result, the driver 145 generates impact loads upon the hammer bit 129 shown in FIG. 2.

Further, in the present embodiment, the counter weight 201 and a counter weight driving device 203 are provided on the motion converting mechanism 123. The counter weight driving device 203 includes a counter weight driving crank 205 and a crank pin 207. The counter weight driving crank 205 has an eccentric pin guide groove 209. The eccentric pin 139 engages the guide groove 209 and is thus connected to the counter weight driving crank 205. The crank pin 207 is integrally formed with the counter weight driving crank 205 on its front end region (left end region as viewed in FIG. 3). The counter weight driving crank 205 is rotatably supported by the inner peripheral surface of the crank cap 109 via a bearing 206 and can rotate within the horizontal plane.

The dynamic vibration reducer 301 is disposed on the counter weight 201 and the counter weight driving device 203. The dynamic vibration reducer 301 has an elongated hollow cylindrical body 303. The cylindrical body 303 is a feature that corresponds to the "body" of the dynamic vibration reducer according to the present invention. A weight 305 is disposed within the cylindrical body 303 and extends in the axial direction of the body 303. The weight 305 has a large-diameter portion 313 and a small-diameter portion 315. A biasing spring 317 is mounted on the right and left sides of the large-diameter portion 313. The biasing spring 317 is a feature that corresponds to the "elastic element" according to the present invention. The biasing spring 317 exerts an elastic force on the weight 305 between the spring and the body 303 while moving in the axial direction of the body 303.

The counter weight 201 and the counter weight driving device 203 are mounted in the opening 110 of the hammer 101, and the dynamic vibration reducer 301 is mounted right on the opening 110. The counter weight 201, the counter weight driving device 203 and the dynamic vibration reducer 301 can be readily mounted to and removed from the hammer 101. The counter weight driving device 203 can be removed above the opening 110 together with the crank cap 109 as mentioned above. Thus, efficiency in the mounting and dismounting operation can be ensured. The eccentric pin 139 of the speed change gear 135 is only loosely and removably fitted from below in the eccentric pin guide groove 209 of the counter weight driving crank 205. Thus, the eccentric pin 139 does not impair the removability of the counter weight driving device 203.

Hammer 101 according to this embodiment is constructed as described above. Operation and usage of the hammer 101 will now be explained. When the driving motor 121 is driven, the torque of the driving motor 117 is transmitted to the speed change gear 135 via the output shaft 131 and the gear portion 133 of the output shaft 131. Thus, the speed change gear 135 is rotated together with the gear shaft 137. When the speed change gear 135 rotate, the eccentric pin 139 revolves around the axis of rotation of the gear shaft 137, which in turn causes the crank arm 143 to reciprocate rightward and leftward as viewed in the drawings. Then, the driver 145 reciprocates within the bore of the cylinder 147.

When the driver 145 reciprocates, a striker (not shown) collides with an impact bolt (not shown) at a speed higher than the driver 145 by the action of the air spring function as a result of the compression of the air within the cylinder 147 between the striker and the impact bolt. As a result, the hammer bit 129 (see FIG. 2) reciprocates at a higher speed by the kinetic energy caused by the collision. Thus, the hammering operation is performed on a workpiece (not shown).

Figure 4:
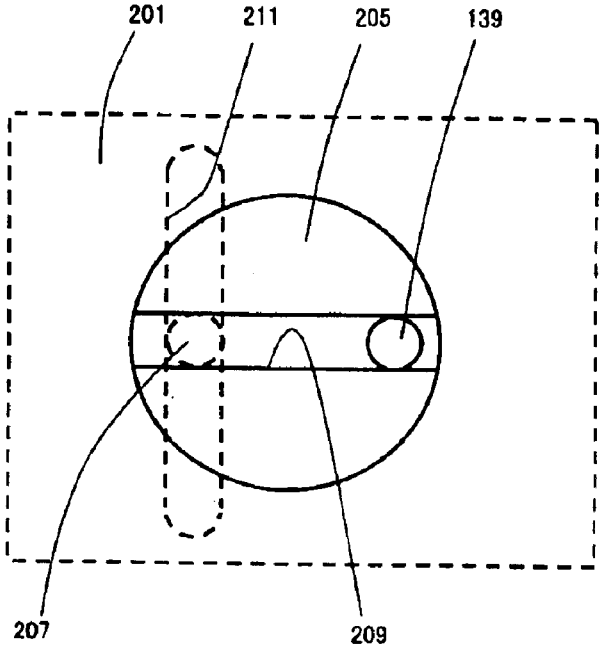
FIG. 4 is a schematic view showing the construction of the counter weight driving device.

In this embodiment, the counter weight 201 is driven by using the revolution of the eccentric pin 139 of the motion converting mechanism 123 as shown in FIG. 3. With respect to the manner of driving the counter weight 201, the relationship of the eccentric pin 139, the counter weight driving crank 205, the eccentric pin guide groove 209, the crank pin 207 and the counter weight 201 is schematically shown in FIG. 4. As described above, when the eccentric pin 139 revolves around the axis of rotation of the gear shaft 137, the eccentric pin guide groove 209 receives the revolution of the eccentric pin 139, which causes the counter weight driving crank 205 to rotate. Then, the crank pin 207 eccentrically disposed on the counter weight driving crank 205 revolves in a position diametrically opposed to the eccentric pin 139.

Further, due to the construction in which the eccentric pin 139 is loosely fitted in the eccentric pin guide groove 209, it is not necessary to mount it with high accuracy. Therefore, the cost effectiveness and mountability can be improved in such a hammer.

A crank pin guide slot 211 is formed in the counter weight 201 and extends in a direction crossing the longitudinal direction of the counter weight 201 (in a vertical direction as viewed in FIG. 4). The revolving motion of the crank pin 207 has a linear motion component in the longitudinal direction of the counter weight 201. Solely this linear motion component is transmitted to the counter weight 201. Thus, the counter weight 201 reciprocates in a direction opposite to the direction of the revolution of the eccentric pin 139 or to the reciprocating direction of the striker 128.

Thus, when the striker is caused to reciprocate by the crank arm 143 reciprocating in the longitudinal direction of the hammer 101 (rightward and leftward as viewed in FIG. 3), the counter weight 201 reciprocates in a direction opposite to the reciprocating direction of the striker. As a result, the dynamic vibration of the striker is efficiently reduced. Further, in the present embodiment, in addition to the vibration reducing function of the counter weight 201, the dynamic vibration reducer 301 also serves to reduce dynamic vibration of the striker 128. Therefore, vibration which will be developed during operation of the hammer 101 can be considerably reduced, so that ease of use and the quietness of the hammer 101 can be improved.

The counter weight 201 of the present embodiment is configured to perform the vibration reducing function by reciprocating in a direction opposite to the reciprocating direction of the striker 128 under loaded driving conditions. Therefore, the counter weight 201 effectively performs the vibration reducing function under loaded driving conditions. However, to the contrary, under unloaded driving conditions, the counter weight 201 may possibly become a source of vibration because counter weight 201 is driven while the object of vibration reduction for the counter weight 201 does not move.

In this embodiment, under such unloaded driving conditions, even if the vibration is caused by the counter weight 201, the above-mentioned dynamic vibration reducer 301 effectively performs the vibration reducing function against such vibration. Specifically, in the hammer according to this embodiment, under loaded driving conditions, the dynamic vibration reducer 301 serves to reduce vibration of the striker 128 in cooperation with the counter weight 201 of which phase has been adjusted in relation to the loaded driving conditions. Under unloaded driving conditions, the dynamic vibration reducer 301 serves to reduce vibration of the counter weight 201 as well as the striker 128.

Moreover, in this embodiment, the counter weight 201 and the counter weight driving device 203 can be readily removed from the hammer 101 through the opening 110 above the crank cap 109. Further, the dynamic vibration reducer 301 can be easily detached from above the opening 110. Whether each of these vibration reducing elements is mounted or removed can be selected according to the operating manners, the need for dynamic vibration reduction or other similar conditions. Thus, the cost, convenience, outer dimensions, weight or other similar factors of the hammer can be efficiently adjusted.

A hammer according to a modification of this embodiment will be explained with reference to FIG. 5. The hammer 102 is a modification made with respect to the manner of connection between the eccentric pin 139 and the counter weight driving device 203. Elements having the same effects as in the hammers 100, 101 will be designated by the same numerals in the drawings and will not be described below in detail.

Figure 5:
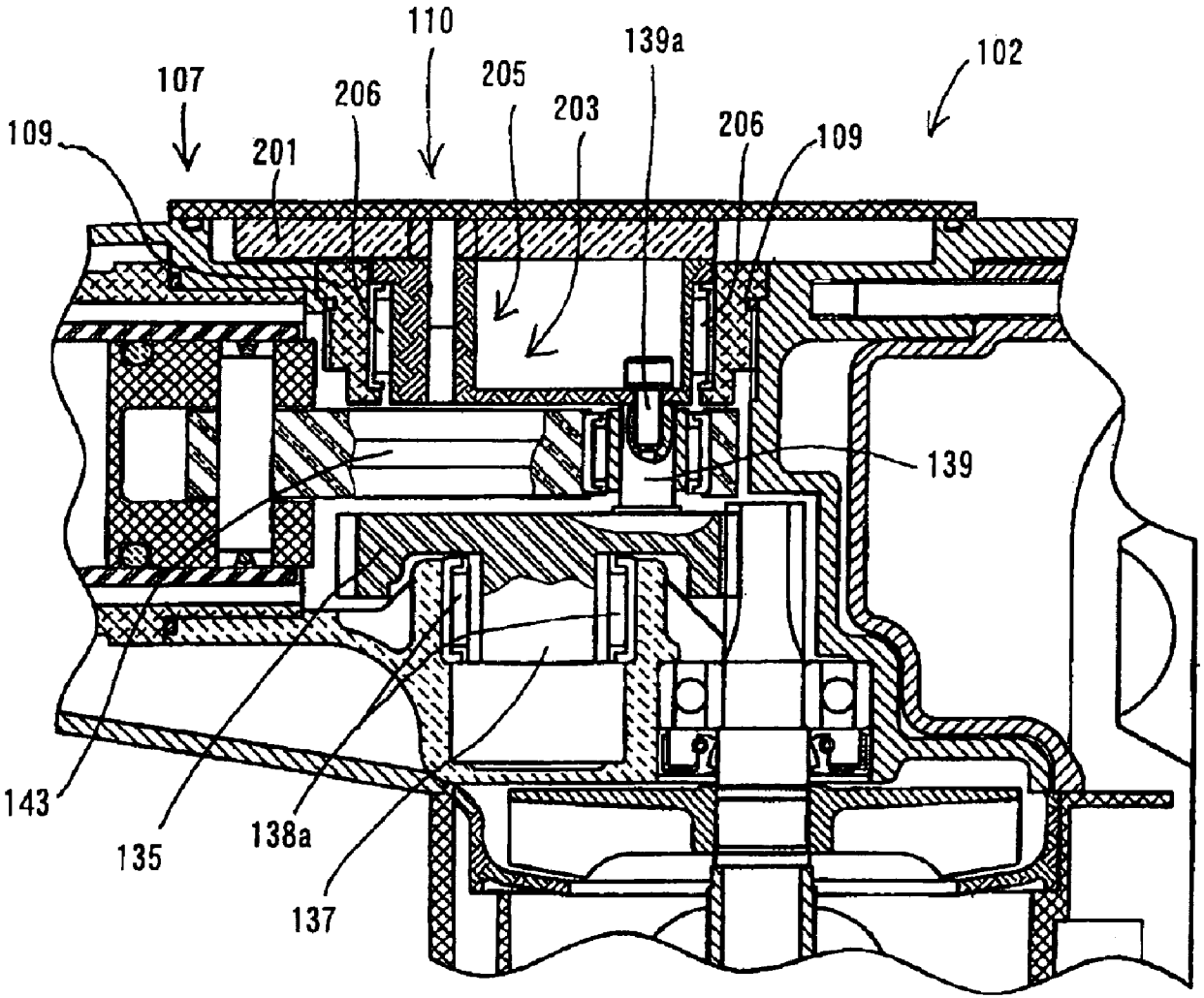
FIG. 5 is a partially sectional view showing the construction of the modified hammer 102.

As shown in FIG. 5, the eccentric pin 139 on the speed change gear 135 is removably fixed to the counter weight driving crank 205 via a lock pin 139*a*. The counter weight driving crank 205 forms an essential part of the counter weight driving device 203 and can rotate with respect to the crank cap 109 via a bearing 206 in the lower region of the opening 110. The counter weight 201 reciprocates in the longitudinal direction of the hammer 102 (rightward and leftward as viewed in FIG. 5) as the counter weight driving crank 205 rotates. In this manner, the counter weight 201 serves to reduce vibration from the reciprocating motion of the crank arm 143.

In this modification, because the eccentric pin 139 is fixed to the counter weight driving crank 205 via the lock pin 139*a*, the speed change gear 135, the gear shaft 137, the eccentric pin 139, the lock pin 139*a* and the counter weight driving crank 205 are integrally rotated as one rigid body. Therefore, the stability of such driving rotation can be ensured simply by rotatably supporting the upper and lower portions of the integral rigid body in an appropriate manner. In this modification, an upper bearing 206 and a lower bearing 138*a* are used as such supports for rotatably supporting the integral rigid body. Thus, in this modification, it is not necessary to provide a support for the speed change gear 135 and the gear shaft 137 and a support for the counter weight driving crank 205 separately. Simply the integral rigid body having a considerable height needs to be rotatably supported. Therefore, even if the mounting accuracy of each component is roughly set to some reasonable extent, the driving rotation will not be easily impaired. Thus, an effective construction can be achieved in terms of simplification of the internal mechanism and stable support of the rotational elements.

Furthermore, these elements can be removed through the opening 110 simply by releasing the lock between the eccentric pin 139 and the counter weight driving crank 205 via the lock pin 139*a*. Thus, the removability of the vibration reducing mechanism can be further improved.

DESCRIPTION OF NUMERALS

100, 101, 102 hammer
103 body
105 motor housing
107 gear housing
109 crank cap
109 hammer bit mounting chuck
110 opening
111 hammer bit coupling portion
113 hand grip
121 driving motor
123 motion converting mechanism
125 cylinder mechanism
127 striking element
128 striker
129 hammer bit
131 output shaft
133 gear portion
135 speed reduction gear
137 gear shaft
138*a*, 138*b* gear shaft bearing
139 eccentric pin
141 eccentric pin bearing
143 crank arm
145 driver
147 cylinder
201 counter weight
203 counter weight driving device
205 counter weight driving crank
206 crank bearing
207 crank pin
209 eccentric pin guide groove
211 crank pin guide groove
301 dynamic vibration reducer
303 cylindrical body (body)
305 weight
313 large-diameter portion
315 small-diameter portion
317 biasing spring (elastic element)

What is claimed is:

1. An electric hammer comprising:

a hammer bit, a driving motor, a crank mechanism that drives a striker by converting a rotating output of the driving motor to linear motion in the axial direction of the hammer bit and a counter weight that is detachably mounted to the crank mechanism and serves to reduce vibration of the striker.

2. The electric hammer as defined in claim 1, further comprising a dynamic vibration reducer having a body, a weight that is housed in the body and an elastic element that connects the weight to the body, the dynamic vibration reducer being detachably mounted to the hammer.

3. The electric hammer as defined in claim 2, wherein the counter weight is adapted to reciprocate in a direction opposite to the reciprocating direction of the striker when load is applied to the hammer bit and the dynamic vibration reducer is adapted to reduce vibration from the reciprocating motions of the striker and the counter weight when no load is applied to the hammer bit.

4. The electric hammer as defined in claim 1, wherein the crank mechanism includes a gear that is drivingly rotated by an output shaft of the driving motor, an eccentric pin that is eccentrically mounted on the gear and revolves with rotation of the gear and a crank arm, one end of the crank arm being connected to the eccentric pin and the other end of the crank arm being connected to the hammer bit striking mechanism, thereby causing the hammer bit striking mechanism to reciprocate and thus driving the striker, wherein the hammer further comprising a counter weight driving device, the counter weight driving device being removably connected to the eccentric pin and reciprocates in the axial direction of the hammer bit to drive the counter weight to reciprocate.

5. The electric hammer as defined in claim 4, wherein the counter weight driving device has an eccentric pin sliding groove, the eccentric pin being removably fitted in the eccentric pin sliding groove and allowed to slide with respect to the sliding groove.

6. The electric hammer as defined in claim 4, wherein the counter weight driving device has a second crank arm, one end of the second crank arm being removably connected to the eccentric pin and the other end of the second crank arm being connected to the counter weight.

7. The electric hammer as defined in claim 4, wherein the counter weight and the counter weight driving device are mounted and removed through the crank cap that is used to dispose the crank arm in the hammer body or through the opening formed above the crank mechanism.

8. An electric hammer comprising:

a hammer bit, a driving motor, a crank mechanism that drives a striker by converting a rotating output of the driving motor to linear motion in the axial direction of the hammer bit, a counter weight that is detachably mounted to the crank mechanism and serves to reduce vibration of the striker and a dynamic vibration reducer having a body, a weight that is housed in the body and an elastic element that connects the weight to the body, the dynamic vibration reducer being detachably mounted to the hammer.

9. An electric hammer comprising:

a hammer bit, a driving motor, a crank mechanism that drives a striker by converting a rotating output of the driving motor to linear motion in the axial direction of the hammer bit, a counter weight that is detachably mounted to the crank mechanism and serves to reduce vibration of the striker and a dynamic vibration reducer having a body, a weight that is housed in the body and an elastic element that connects the weight to the body, the dynamic vibration reducer being detachably mounted to the hammer, wherein the counter weight is adapted to reciprocate in a direction opposite to the reciprocating direction of the striker when load is applied to the hammer bit and the dynamic vibration reducer is adapted to reduce vibration from the reciprocating motions of the striker and the counter weight when no load is applied to the hammer bit.

10. An electric hammer comprising:

a hammer bit, a driving motor, a crank mechanism that includes a gear that is drivingly rotated by an output shaft of the driving motor, an eccentric pin that is eccentrically mounted on the gear and revolves with rotation of the gear and a crank arm, one end of the crank arm being connected to the eccentric pin and the other end of the crank arm being connected to the hammer bit striking mechanism, thereby causing the hammer bit striking mechanism to reciprocate and thus driving the striker, a counter weight that is detachably mounted to the crank mechanism and serves to reduce vibration of the striker and a counter weight driving device that is removably connected to the eccentric pin and reciprocates in the axial direction of the hammer bit to drive the counter weight to reciprocate.

11. An electric hammer comprising:

a hammer bit, a driving motor, a crank mechanism that includes a gear that is drivingly rotated by an output shaft of the driving motor, an eccentric pin that is eccentrically mounted on the gear and revolves with rotation of the gear and a crank arm, one end of the crank arm being connected to the eccentric pin and the other end of the crank arm being connected to the hammer bit striking mechanism, thereby causing the hammer bit striking mechanism to reciprocate and thus driving the striker, a counter weight that is detachably mounted to the crank mechanism and serves to reduce vibration of the striker and a counter weight driving device that is removably connected to the eccentric pin and reciprocates in the axial direction of the hammer bit to drive the counter weight to reciprocate, wherein the counter weight driving device has an eccentric pin sliding groove, the eccentric pin being removably fitted in the eccentric pin sliding groove and allowed to slide with respect to the sliding groove.

12. An electric hammer comprising:

a hammer bit, a driving motor, a crank mechanism that includes a gear that is drivingly rotated by an output shaft of the driving motor, an eccentric pin that is eccentrically mounted on the gear and revolves with rotation of the gear and a crank arm, one end of the crank arm being connected to the eccentric pin and the other end of the crank arm being connected to the hammer bit striking mechanism, thereby causing the hammer bit striking mechanism to reciprocate and thus driving the striker, a counter weight that is detachably mounted to the crank mechanism and serves to reduce vibration of the striker and a counter weight driving device that is removably connected to the eccentric pin and reciprocates in the axial direction of the hammer bit to drive the counter weight to reciprocate, wherein the counter weight driving device has a second crank arm, one end of the second crank arm being removably connected to the eccentric pin and the other end of the second crank arm being connected to the counter weight.

13. An electric hammer comprising:

a hammer bit, a driving motor, a crank mechanism that includes a gear that is drivingly rotated by an output shaft of the driving motor, an eccentric pin that is eccentrically mounted on the gear and revolves with rotation of the gear and a crank arm, one end of the crank arm being connected to the eccentric pin and the other end of the crank arm being connected to the hammer bit striking mechanism, thereby causing the hammer bit striking mechanism to reciprocate and thus driving the striker, a counter weight that is detachably mounted to the crank mechanism and serves to reduce vibration of the striker and a counter weight driving device that is removably connected to the eccentric pin and reciprocates in the axial direction of the hammer bit to drive the counter weight to reciprocate, wherein the counter weight and the counter weight driving device are mounted and removed through the crank cap that is used to dispose the crank arm in the hammer body or through the opening formed above the crank mechanism.

14. An electric hammer comprising:

a hammer bit, a driving motor, a crank mechanism that includes a gear that is drivingly rotated by an output shaft of the driving motor, an eccentric pin that is eccentrically mounted on the gear and revolves with rotation of the gear and a crank arm, one end of the crank arm being connected to the eccentric pin and the other end of the crank arm being connected to the hammer bit striking mechanism, thereby causing the hammer bit striking mechanism to reciprocate and thus driving the striker, a counter weight that is detachably mounted to the crank mechanism and serves to reduce vibration of the striker, means for driving a counter weight that is removably connected to the eccentric pin and reciprocates in the axial direction of the hammer bit to drive the counter weight to reciprocate and a dynamic vibration reducer having a body, a weight that is housed in the body and an elastic element that connects the weight to the body, the dynamic vibration reducer being detachably mounted to the hammer wherein the counter weight is adapted to reciprocate in a direction opposite to the reciprocating direction of the striker when load is applied to the hammer bit and the dynamic vibration reducer is adapted to reduce vibration from the reciprocating motions of the striker and the counter weight when no load is applied to the hammer bit.

* * * * *